US006431024B1

(12) United States Patent
Yuasa et al.

(10) Patent No.: US 6,431,024 B1
(45) Date of Patent: Aug. 13, 2002

(54) BACKPACK-TYPE WORKING MACHINE

(75) Inventors: Tsuneyoshi Yuasa, Kobe; Kunio Tsutsui, Hyogo; Junichi Miyamoto, Togane, all of (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 09/539,576

(22) Filed: Mar. 31, 2000

(30) Foreign Application Priority Data

Apr. 1, 1999 (JP) ..... 11-094539

(51) Int. Cl.[7] ..... G05G 1/04; A47L 5/00; F02B 63/00

(52) U.S. Cl. ..... 74/519; 74/522.5; 74/526; 15/405; 123/2; 403/92

(58) Field of Search ..... 74/519, 522.5, 74/526; 15/405; 123/2; 403/84, 92, 94

(56) References Cited

U.S. PATENT DOCUMENTS 1,994,677 A * 3/1935 Wildhaber ..... 403/92 X
4,552,100 A * 11/1985 Kawaharazuka et al. ..... 123/2
5,133,300 A * 7/1992 Miura ..... 123/2
5,813,088 A * 9/1998 Wagner et al. ..... 15/405 X
5,873,284 A * 2/1999 Stegall et al. ..... 74/525

FOREIGN PATENT DOCUMENTS

JP HE12-104009 10/1990

* cited by examiner

*Primary Examiner*—Allan D. Herrmann
(74) *Attorney, Agent, or Firm*—Oppenheimer Wolff & Donnelly LLP

(57) ABSTRACT

A backpack-type working machine comprises an engine on a shouldering frame and a swingable arm on a side thereof. A throttle lever on the arm controls the engine. A base of the arm is connected to a holder by means of an elastic pivot means including a bolt around which the arm swings and a spring. To allow the arm to move on a plane orthogonal to a swing direction (plane including a center line of a pivot means), the holder and the base of the arm are connected such that only parts opposing and oppositely of inclined surfaces thereof are in partial contact with each other.

8 Claims, 6 Drawing Sheets

FIG. 1
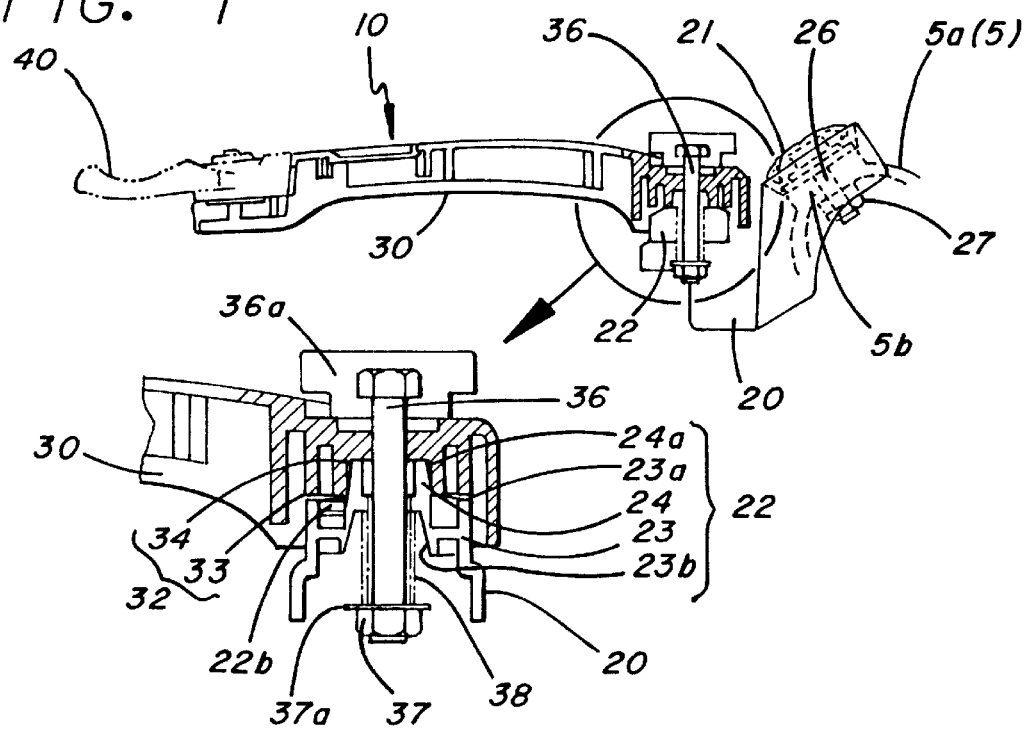
FIG. 1A
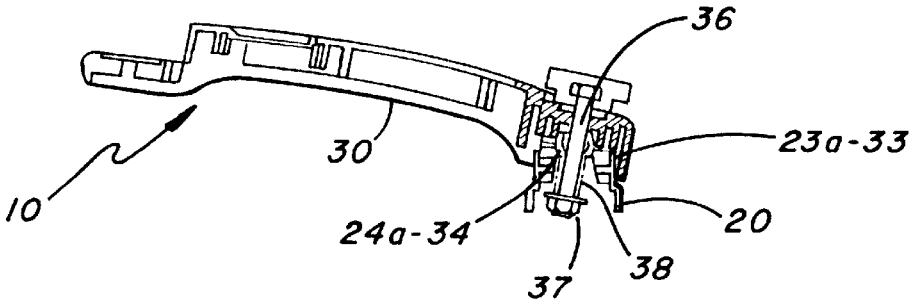
FIG. 1B
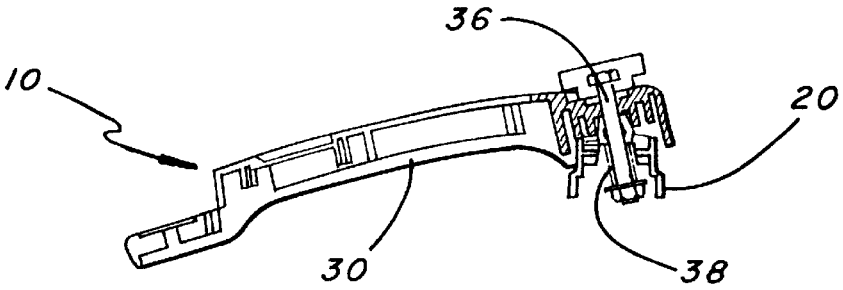
FIG. 1C

BACKPACK-TYPE WORKING MACHINE

BACKGROUND OF THE INVENTION

1. . Field of the Invention

The present invention relates to a backpack-type working machine such as a power blower, a power sprayer, or a brush cutter that comprises a mechanical unit (fan, reduction gear or the like) and a power unit (engine) on a shouldering frame and operates the power unit and the like by using a control device on a swingable arm.

2. Description of the Related Art

FIGS. 2A and 2B show a power blower for cleaning as an example of a backpack-type working machine. While these figures relate to the present invention, the configuration or usages described herein for the mechanical unit and power unit are identical to that of the prior art. As shown in FIGS. 2A and 2B, an exemplary power unit, an engine 3, and an exemplary mechanical unit, a fan 5, are mounted on a shouldering frame 2 with a shouldering belt 2*a*. A flexible tube 6 is connected to an outlet of the fan 5 and has a discharge port (not shown) of cleaning air at an end thereof. An operator trying to clean trash or fallen leaves in a wide place, holding a discharge duct (not shown) at the end of the tube 6 and directing it to a spot to be cleaned, moves around in order to gather the trash or the like. A throttle lever 40 is provided at an end of a controller 10 mounted on a side of the shouldering frame 2. The operator controls the speed (the number of revolutions per unit of time) of the engine 5 by using the lever 40.

FIGS. 6A and 6B show a configuration in which a controller is attached to the conventional backpack-type working machine. This working machine is described in Japanese Utility Model Application Publication No. 7-6780. A holder 20' is fixed to a side (left-hand side of the operator) of the shouldering frame 2'. A base of an arm 30' of the controller 10' is connected to the holder 20' by means of a bolt 36' and a nut 37' through a spring 38'. The bolt 36' is a pivot around which the arm 30' swings. The spring 38' sets a connecting force between the base of the arm 30' and the holder 20' to allow the arm 30' to swing while being braked moderately. The operator shoulders the working machine, swings the arm 30' of the controller 10' directed upward as shown in FIG. 6A toward a horizontal point where the arm 30' is easy-to-handle as shown in FIG. 6B, and then operates the throttle lever 40' at the end thereof.

In the conventional working machine, the holder 20' fixed to the shouldering frame 2' or the like and the base of the arm 30' which swings as described above are connected such that their contact surfaces 23', 33' are in close contact with each other as shown in FIG. 6A. For this reason, the arm 30' swings on the surface 23' of the holder 20', that is, around the bolt 36' orthogonal to the surface 23'.

In the illustrated example of FIGS. 6A and 6B, the arm 30' extends in a direction not orthogonal to the bolt 36' around which the arm 30' swings. Therefore, the end portion (throttle lever 40') of the arm 30' moves as shown by a virtual line "y" of FIGS. 6A and 6B along with the swing of the arm 30', and the arm 30' swings such that it turns on a conical plane.

In the conventional backpack-type working machine in which the contact surface 23' of the fixed holder 20' and the contact surface 33' of the base of the swingable arm 30' closely contact each other as shown in FIG. 6A, there is a tendency that the arm 30' highly vibrates and a shocking external force is unintentionally applied on the holder 20' or the arm 30'. The reason for the high vibration of the arm 30' is that vibration of an engine or the like tends to be transmitted to the arm 30' through contact portions of the holder 20' and the base of the arm 30' because their surfaces are in close contact with each other. When the arm 30' vibrates highly, an arm of the operator holding the arm 30' is exhausted. The reason why the arm 30' or the like is subject to the shocking external force is that the surface of the holder 20' and the surface of the base of the arm 30' are in close contact with each other and therefore they are under strong restraint, so that when the arm 30' is bumped into something and a force in a direction different from a normal swing direction (on a plane orthogonal to the bolt 36') is unintentionally applied on the arm 30', it concentrates on the contact portions (contact surfaces 23', 33'). When the force is great, a part of the holder 20' or the base of the arm 30' might be deformed or broken off.

When the arm 30' extends in the direction not orthogonal to the bolt 36' around which the arm 30' swings as shown in FIG. 6A, the arm of the operator holding the arm 30' so as to operate the throttle lever 40' is unnaturally twisted when the operator swings the arm 30'. When the end (throttle lever 40') of the arm 30' moves along the virtual line "y", the operator's arm holding the arm 30' in the vicinity of the end moves on the conical plane along with the arm 30', so that the operator feels discomfort in operation.

SUMMARY OF THE INVENTION

The present invention has been developed for the purpose of obviating the aforesaid problem of the conventional working machine, and an object of the present invention is to provide a backpack-type working machine including a controller arm which is capable of absorbing a shocking external force satisfactorily, which makes an operator feel less exhausted, and is easy to handle.

In one aspect of a backpack-type working machine according to the present invention, the backpack-type working machine comprises a power unit (engine or motor) mounted on a shouldering frame, and a swingable arm having a control device such as a throttle lever or access dial, which is attached to a side of the backpack-type working machine(a right-hand or left-hand side of the operator), and is characterized in that (1) a base of the arm is connected to a holder provided integrally with a body of the machine, such as the shouldering frame, the engine, or the like, for supporting the arm at a swing center of the arm by using a pivot, such as a bolt or a pin around which the arm swings through an elastic body such as a spring or a rubber, and (2) the base of the arm and the holder are connected with each other such that the arm and the holder abut with each other at a part of an inclined surface formed between the arm and the holder, to allow the arm to move on a plane orthogonal to a direction, that is, a plane including a center line of the pivot in which the arm swings.

With this configuration, since the swingable arm is on the side of the machine and is provided with the control device, the operator shouldering the working machine can swing the arm to a point where the arm is easy to handle and control the power unit by using the control device. According to the configuration (1) mentioned above, the arm can swing around the pivot while being braked moderately by a force of the elastic body with the base connected to the holder.

Further, according to the configuration (2) mentioned above, in a case where an external force is applied on the arm in the direction different from the normal swing direction, no excess stress is generated at the arm or the holder portion. This is because when the external force including a force component in the direction orthogonal to the normal swing direction (on the plane including the center line of the pivot) is applied on the arm, the arm moves in the direction of the external force. More specifically, since the holder and the base of the arm are connected at a part of the inclined surface in contact with each other according to configuration (2), the arm can swing on the plane including the center line of the pivot unless the other portions of the inclined surfaces make contact with each other. As a result, if the arm. is bumped into something and thereby the external force is unintentionally applied on the arm, no strong reaction force is generated at the arm or the holder.

In addition, in the backpack-type working machine, no high vibration is transmitted to the arm during operation of the power unit. With the configuration (2), since only small areas of the holder and base are in contact with each other, the vibration on the holder which is close to the power unit is likely to be shut off at the contact portions and is less likely to be transmitted to the arm, which makes the operator feel less exhausted.

In another aspect of the backpack-type working machine according to the present invention, convex and concave portions for engagement (recesses formed on one of the holder and the arm and convex portions formed on the other) that maintain angles of the arm at positions where an end of the arm is directed upward and forward (when the operator shoulders the machine) are formed at opposite surfaces of the holder and the base of the arm in a direction of a center line of a pivot between the holder and the base of the arm.

The convex and concave portions for engagement so formed, make it possible that the arm can swing as described above and is maintained with the end thereof directed upward or forward. The upward position is suitable for storage and the forward position is suitable for the operator to hold the arm and operate the arm, that is, when the arm is directed upward, the arm is stored so that it does not protrude from the machine, while when the arm is directed forward, the operator holds the arm and operates the working tool in comfort. Because the arm can be maintained at such positions, this backpack-type working machine is preferable in that the arm can be positioned appropriately depending on whether or not the machine is in use. It should be noted that the arm can swing to another position from the position where it is maintained.

In a further aspect of the backpack-type working machine according to the present invention, the holder portion is formed of; fiber-reinforced- plastic (FRP), for example, GFRP using glass fiber as reinforcement, while the arm is formed of plastic that is not fiber-reinforced, for example, nylon, polyethylene, or polypropylene.

Since the plastic is light weight and is not rusty in contrast with metal, the plastic having some degree of mechanical strength can be a material of constituents of the backpack-type working machine. While the arm or the holder may be formed of the plastic, it is required that the holder have high strength and high hardness, because the holder is a part for supporting the swingable arm via the pivot and is subject to the external force applied on the arm, and its supporting force acts on a small area. In addition, if the holder portion is low in rigidity, the operation of the arm gives the operator undesirable feeling. On the other hand, it is desired that the arm be relatively flexible so as not to generate excess stress at the base of the arm and the holder, when the external force is applied on the arm, and the vibration is not transmitted to the operator's hand during operation.

To meet this demand, as mentioned above, the holder portion is formed of the fiber-reinforced plastic (FRP) that has high strength and hardness, while the arm is formed of the plastic not fiber-reinforced that has low strength and low hardness, but high elongation to absorb displacement and vibration. With this configuration, the holder withstands a long-term use and as the arm is reasonably flexible, the high stress due to the external force is prevented from generating at the base of the arm and the holder when the arm is bumped into something and exhaustion of the operator due to the vibration is reduced.

In a still further aspect of the backpack-type working machine according to the present invention, the pivot is placed horizontally on a side of the shouldering frame such that the pivot is on a left-hand- or right-hand side of the operator and an outer end thereof is directed obliquely rearward, when the operator shoulders the working machine, and the arm extends in a direction orthogonal to the center line of the pivot.

With this configuration, since the arm swings according to the movement of the operator's forearm when the operator bends the operator's elbow, the operator can operate the arm naturally.

More specifically, since the arm extends in the direction orthogonal to the pivot around which the arm swings, the arm swings on a single plane rather than the conical plane already described with reference to FIG. 6. For this reason, the arm of the operator holding the arm in the vicinity of the control device can adapt itself to the movement of the swinging arm. Further, since the pivot is inclined such that the outer end thereof is directed obliquely rearward, the end of the arm extends to the side from the front of the operator when the arm is swung and the end thereof is directed forward. When the arm is thus directed forward and the end thereof thus extends to the side, the operator's arm is extended naturally and the arm is easy to hold. Therefore, the operator can hold the end of the arm in comfort and continue to work without feeling exhausted for a long time. Moreover, since the pivot is directed horizontally, the arm can be positioned vertically when the arm extending orthogonal to the pivot is swung upward, and therefore the working machine is compactly stored.

This object, as well as other objects, features and advantages of the invention will become more apparent to those skilled in the art from the following description taken with reference to the accompanying drawings.

BRIEF DESCRIPTION OF THE DRAWINGS

FIG. 1 is a front elevational view, partially in section, of an exemplary controller for a back pack-type working machine of the present invention;

FIGS. 1A–1C are sectional views showing an embodiment of the present invention., wherein FIG. 1A is a sectional view showing the exemplary controller mounted on a backpack-type working machine of FIG. 2A and 2B and the sectional view taken substantially along line 1A—1A in FIG. 3A, and FIGS. 1B and 1C are side views showing how an arm of the exemplary controller moves;

FIGS. 2A and 2B are general views showing the backpack-type working machine of the exemplary embodiment, wherein FIG. 2A is an elevational view (seen from rear) and FIG. 2B is a side view (seen from left);

FIGS. 5A–5C are general views showing the arm of the controller, wherein FIG. 5B is an elevational view of the controller mounted on the working machine of FIGS. 2A and 2B in a direction of a center of an axis of the bolt, and FIGS. 5A and 5C are side views of the arm of FIG. 5B; and FIGS. 6A and 6B are drawings showing how the exemplary controller is mounted on the conventional backpack-type working machine, wherein FIG. 6A is an elevational view seen from rear of the arm when the controller is directed vertically and upward, and FIG. 6B is a plan view seen from vertically above of the arm when it is directed horizontally.

DETAILED DESCRIPTION OF THE PREFERRED EMBODIMENTS

Hereinafter, an embodiment of the present invention will be described with reference to the drawings.

Figure 2A:
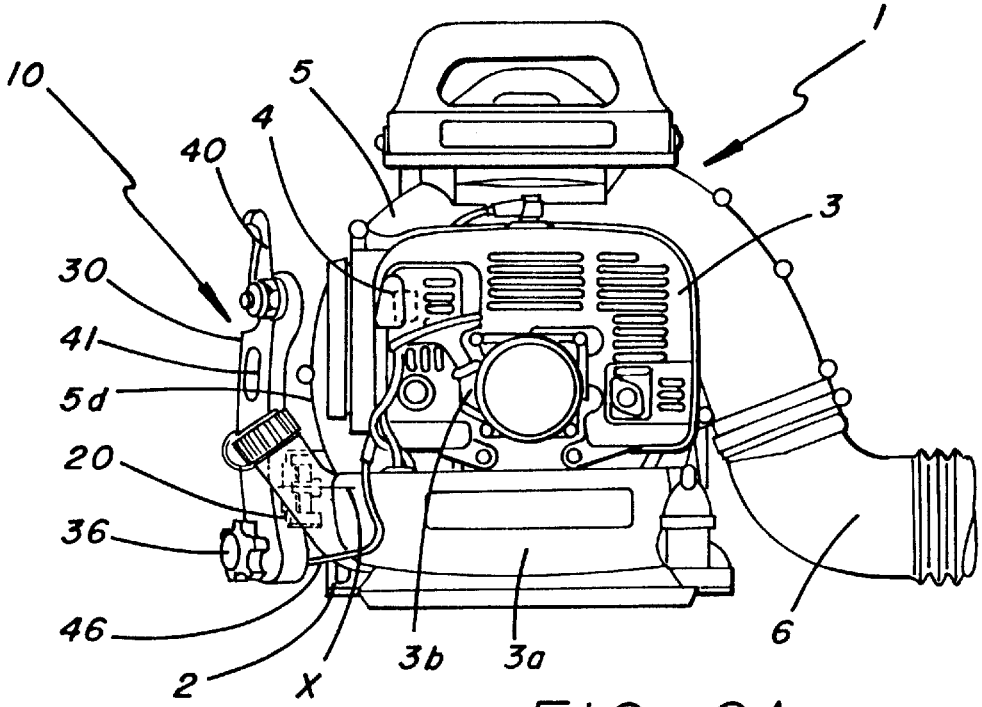
Figure 2B:
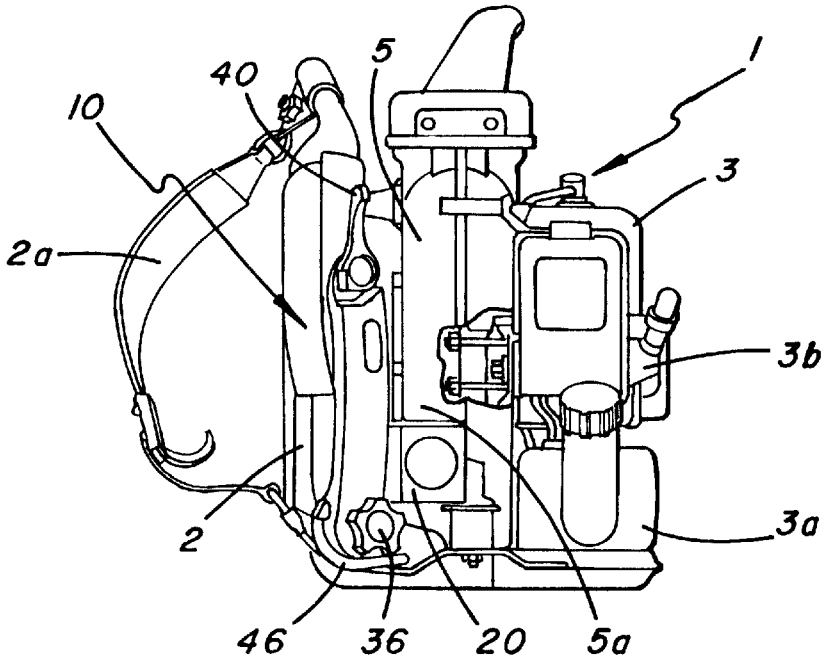

Referring now to FIGS. 2A and 2B, a backpack-type working machine 1 is a power blower for cleaning, which has an engine 3 and a fan 5 mounted on an L-shaped shouldering frame 2 to which a shouldering belt 2*a* is attached. A fuel tank 3*a*, a starter 3*b*, and a carburetor 4 are equipped on the machine 1. A flexible tube 6 is connected to the fan 5 and has a discharge port (not shown) of air for cleaning. Shouldering the working machine 1, the operator holds the tube 6 in the vicinity of the discharge port with the operator's right hand and directs it to a spot to be cleaned, in order to gather trash or fallen leaves by using discharged air. On a left-hand side of the working machine 1, the exemplary controller 10 having an arm 30 extending outward and a throttle lever 40 at an end thereof is disposed as means for controlling the output of the engine 3. The exemplary arm 30 is approximately 25 cm in the total length and is swingable from a vertical position toward a forward and obliquely downward position (see FIGS. 3A). The throttle lever 40 at the end of the arm 30 is connected to the carburetor 4 through a cable 46. The operator holds the arm 30 in the vicinity of the end of the controller 10 and swings the arm 30 to an angular position as the operator prefers. Then, the operator operates the throttle lever 40 with a finger so as to suitably control the speed (number of revolutions per unit of time) of the engine 3 and the volume of air discharged by the fan 5.

In the backpack-type working machine 1, the exemplary controller 10 is configured as follows.

1) The holder 20 for connecting the arm 30 is fixed on a side surface of a casing 5*a* of the fan 5 on a left side of the working machine 1. As illustrated in FIG. 1A, the holder 20 is fixed such that a base 21 of the holder 20 is laid on a flat seat 5*b* formed on the casing 5*a*, a bolt 26 penetrates through both of them, and a nut 27 is attached to the bolt 26. A cap made of resin for preferable appearance is inserted in the base 21 for covering a head portion of the bolt 26. This fastening by means of the bolt 26 and the nut 27 allows the holder 20 to be secured integrally with the casing 5*a* of the fan 5.

Figure 3A:
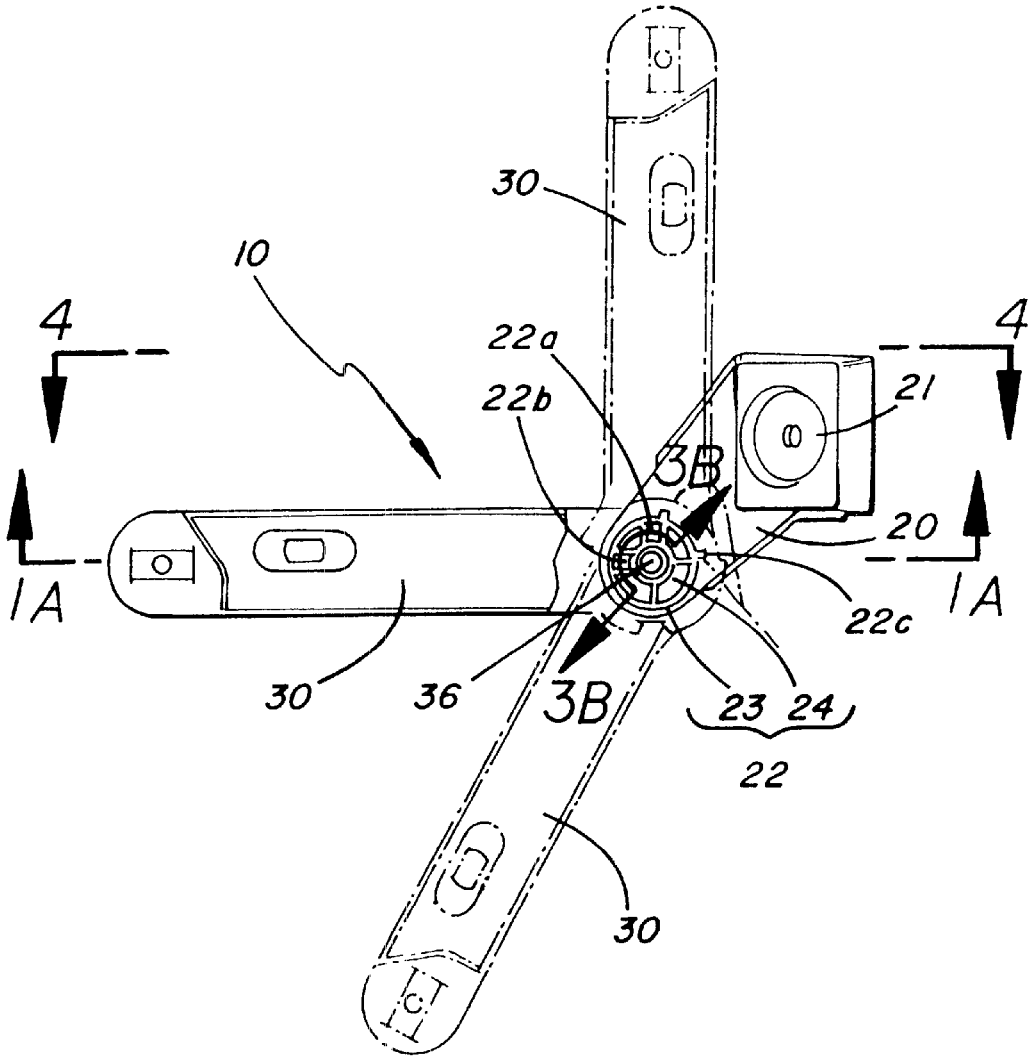
FIG. 3A is a partially sectional view showing a holder and the arm of the controller when seen in a direction orthogonal to the arm from a left side of the working machine and showing how the arm swings.

2) To attach the arm 30 provided with the throttle lever 40 to the working machine 1, as shown in FIG. 1A, a protrusion 22 is formed at an end of the holder 20 according and a base 32 of the arm 30 is fitted thereto. They are fastened by an elastic pivot means including bolt 36 surrounded by a coil spring 38 and a nut 37. The bolt 36 is integral with a cap 36*a* made of resin at the head thereof for improvement of appearance and ease of swing adjustment. The base 32 of the arm 30 and the protrusion 22 of the holder 20 are elastically fixed by the bolt 36 arranged to penetrate through the base 32 and the protrusion 22, and the nut 37 and the washer 37*a* through the spring 38. This makes it possible that the arm 30 has the base 32 closely contact with the holder 20 by an elastic force of the spring 38 and swings around the bolt 36 as shown in FIG. 3A while being braked moderately by a frictional force generated by this close contact. As illustrated in FIGS. 1A, 1B, and 1C, the arm 30 of the controller 10 extends in, a direction substantially orthogonal to a center line 36*b* of the bolt 36 around which the arm 30 swings such that it turns and moves on a vertical plane when it swings. When the operator holds the cap 36*a* and turns the bolt 36 taking care lest the nut 37 should be turned, the compression-length of the spring 38 varies and the elastic force correspondingly varies. Thus, the braking force associated with the swing of the arm 30 can be adjusted.

3) For the protrusion 22 of the holder 20 and the base 32 of the arm 30 so connected, the following configuration is further adopted. Two cylindrical portions 23 and 24 are formed at the protrusion 22 as shown in FIG. 1A. A cylindrical recess 34 in an innermost position and a concave end face 33 extending from an inlet end of the recess 34 in an inner position are formed at the base 32 of the arm 30 so that the end of the cylindrical portion 23 is contact with the end face 33 and the cylindrical portion 24 is fitted into the recess 34. Inclined surfaces tapered in the axis of the protrusion 22 toward an upper end thereof (end face, circumferential outer surface, and circumferential inner surface) 23*a*, 24*a*, and 23*b* are formed at the end of the cylindrical portion 23, an outer circumference of the cylindrical portion 24, and an inner circumference of the cylindrical portion 23 that contains the spring 38, respectively. Because the end face 33 of the arm 30 is an uninclined surface, only a part of the end face 33 and a part of the inclined surface 23*a* are contact with each other as shown in FIG. 1A and therefore, there is a clearance between the portions other than the contact portions. Likewise, a part of the recess 34 of the arm 30 as a cylindrical surface and a part of the inclined surface 24*a* of the holder 20 are contact with each other and, therefore, there is a clearance between the portions other than the contact portions. There is also a wide clearance between the bolt 36 or the spring 38 and the inclined surface 23*b* of the holder 20 as shown in FIG. 1A. These clearances allow the arm 30 to swingably move on a plane orthogonal to the swing direction (a plane including the center line 36*b* of the pivot 36 of the bolt 36) shown in FIG. 3A. Therefore, if an external force is applied on the arm 30 of FIG. 1A from above or below in the drawing, the arm moves as shown in FIG. 1B or FIG. 1C. A movement angle is the largest when the end face 33 of the arm 30 makes contact with an outer portion of the inclined surface 23*a*, the inclined surface 24*a* makes contact with a deeper portion of the recess 34, or the spring 38 makes contact with the inclined surface 23*b*. Since the arm 30 can thus move, excess stress is hardly generated at the base 32 or the protrusion 22 or the like of the holder 20, when the arm 30 is bumped into something and the external force in the direction different from the swing direction is applied on the arm 30. When the arm 30 comes free from the external force, it returns to its original position of FIG. 1A by the force of the spring 38. In normal operation, since a contact area of the arm 30 with respect to the holder 20 is limited to only a part of the inclined surface 23*a* and a part of the end face 33, vibration transmitted to the arm 30 from the engine side (the holder 20's side) during operation is low, and therefore the operator is less exhausted.

Figure 3B:
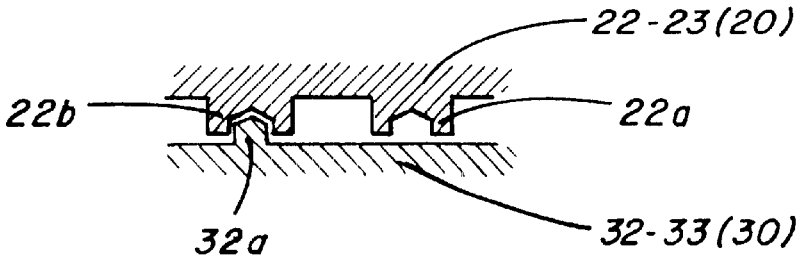
FIG. 3B is a sectional view taken substantially along line 3B—3B in FIG. 3A.

4) For the protrusion 22 of the holder 20 and the base 32 of the arm 30, an exemplary configuration for fixing the arm 30 on the holder 20 at a fixed angle (swing angle) is adopted. Specifically, shallow concaves 22*a* and 22*b* are formed around the end of the cylindrical portion 23 of the protrusion 22 and a convex portion 32*a* that can be engaged in the concaves 22*a* and 22*b* is formed as a part of the end face 33 of the base 32 of the arm 30 as shown in FIGS. 3A and 3B. When the arm 30 is swung around the bolt 36, the convex portion 32*a* is engaged in the concave 22*a* or 22*b* of the holder 20. Thereby, the arm 30 remains at a corresponding position if the operator's hand is taken off of the arm 30. Since the convex portion 32*a* of the arm 30 is formed in the longitudinal direction of the arm 30 and directed toward the outer end thereof, and the concaves 22*a* and 22*b* of the holder 20 are formed upward in the vertical direction and forward in the horizontal direction, respectively, the arm 30 is maintained with the end thereof directed upward or forward. When the arm 30 is directed upward, it is stored as shown in FIGS. 2A and 2B and does not protrude from the working machine 1, while when the arm 30 is directed forward, it is easy for the operator to hold the arm 30 with the operator's left hand. When the convex portion 32*a* is out of engagement with the concaves 22*a* or 22*b*, the arm 30 is subjected to only the. braking force based on the spring 38 and can swing freely to a point at an angle of 60° downward from the horizontal direction, (the point corresponding to a lower-most position of FIG. 3A). It should be noted that the range in which the arm 30 thus swings is not limited to 60° because it is determined by a stopper 22*c* provided on the protrusion 22 of the holder 20 and selected as required.

Figure 4:
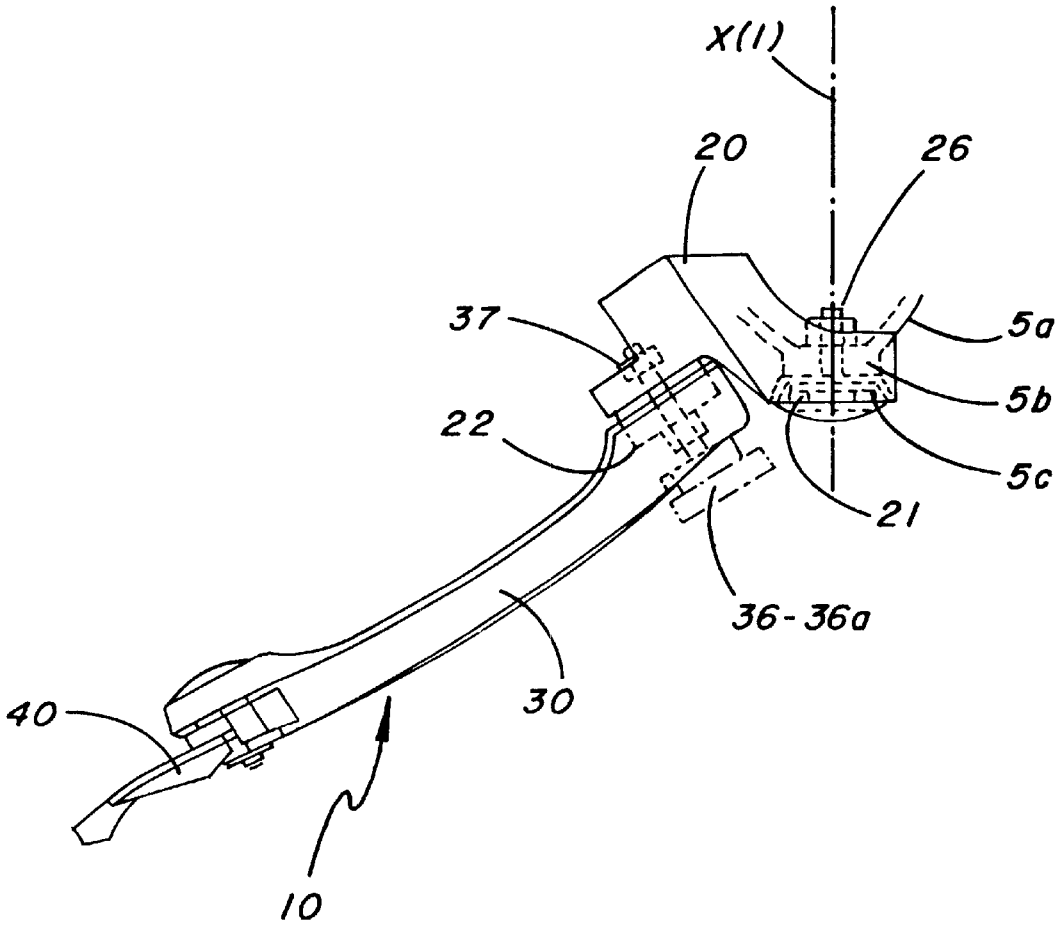
FIG. 4 is a plan view seen from vertically above of the controller and a view taken in the direction of arrows substantially along line 4—4 in FIG. 3A.

5) Since the arm 30 swings on the vertical plane as described above in section 2), the operator holding the arm end can easily adapt the operator's left arm to the movement of the arm 30. In addition, in order to make the movement of the operator's arm natural and thereby make the operator's arm less exhausted, the fixed position or shape of the holder 20 of the controller 10 is determined as follows. The fixed position of the holder 20 of FIG. 2A is determined such that the bolt 36 or the protrusion 22 (see FIG. 3) is closer to the elbow (elbow of the left arm) of the operator shouldering the working machine 1. This makes it possible for the operator to move the operator's forearm according to the swing of the arm 30 by bending the operator's elbow naturally. As for the shape of the holder 20, the base 21 and the protrusion 22 are spaced apart from each other as shown in FIG. 3A and are formed in a direction neither parallel nor perpendicular to each other such that the bolts 26 and 36 make an angle of approximately 30° on a horizontal plane, as shown in FIG. 4. The reason why the base 21 and the protrusion 22 are spaced from each other is that the protrusion 22 is required to be positioned close to the elbow separately from the seat 5*b* of the casing 5*a* to which the base 21 is fixed. The reason why the base 21 and the protrusion 22 make the above angle is that while a seat surface 5*c* of the seat 5*b* is orthogonal to a horizontal line x in rightward and leftward of the working machine 1 (see FIG. 2B), the end of the arm 30 preferably extends slightly sideward (left side) so that the operator can hold the arm 30 naturally when the operator swings the arm 30 forward. In other words, in order to realize that the operator holds the arm in comfort naturally, the protrusion 22 (the bolt 36 around which the arm 30 swings) is inclined with respect to the base 21 as described above.

Figure 5A:
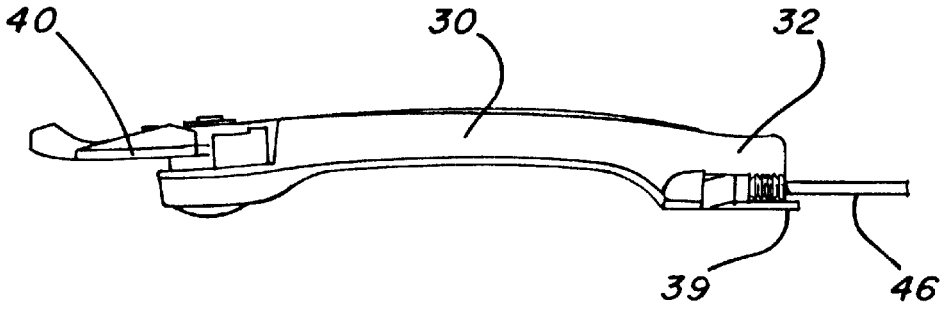
Figure 5B:
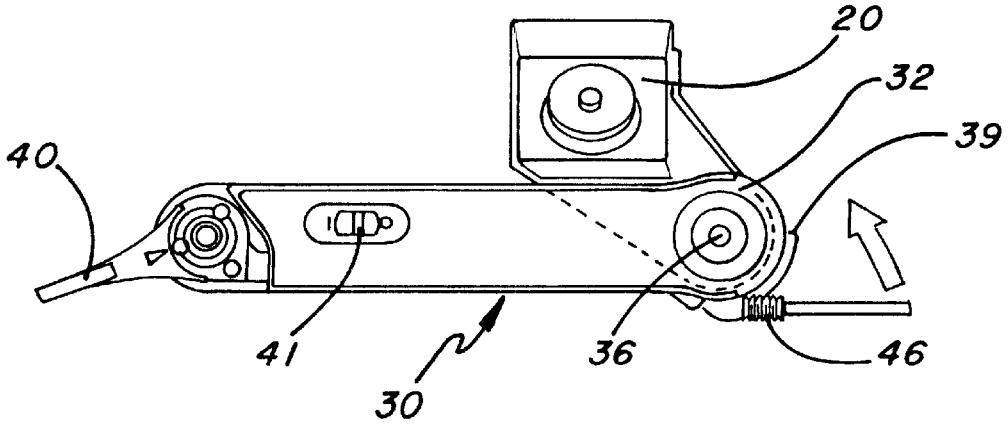
Figure 5C:
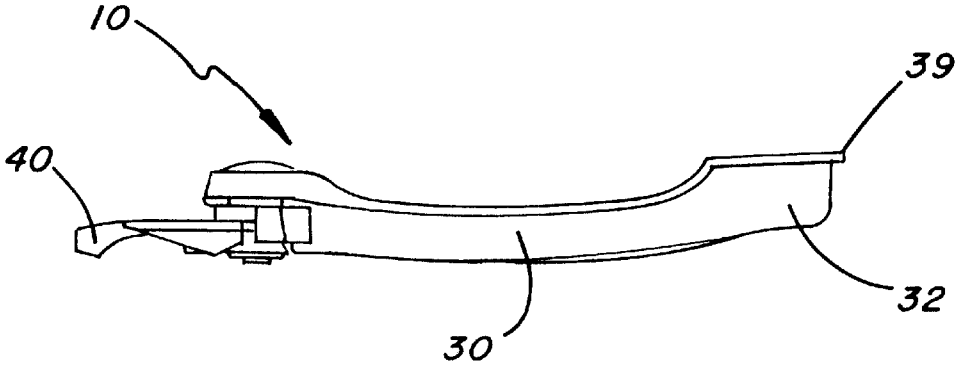
Figure 6A:
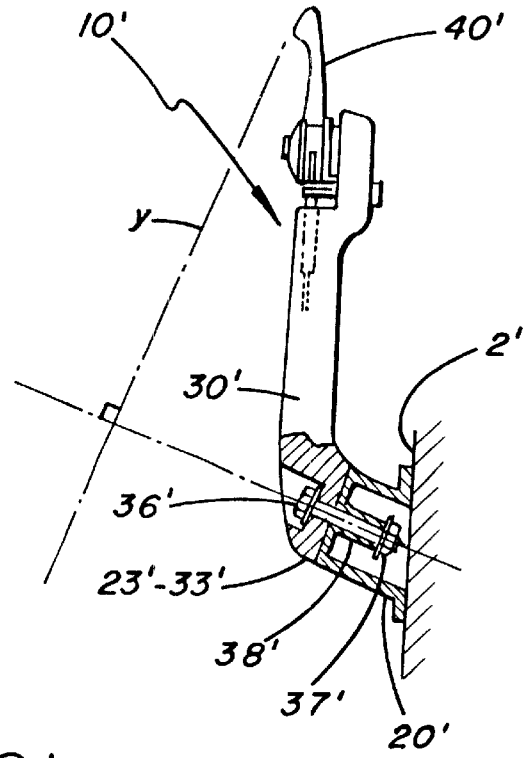
FIG. 6A PRIOR ART
Figure 6B:
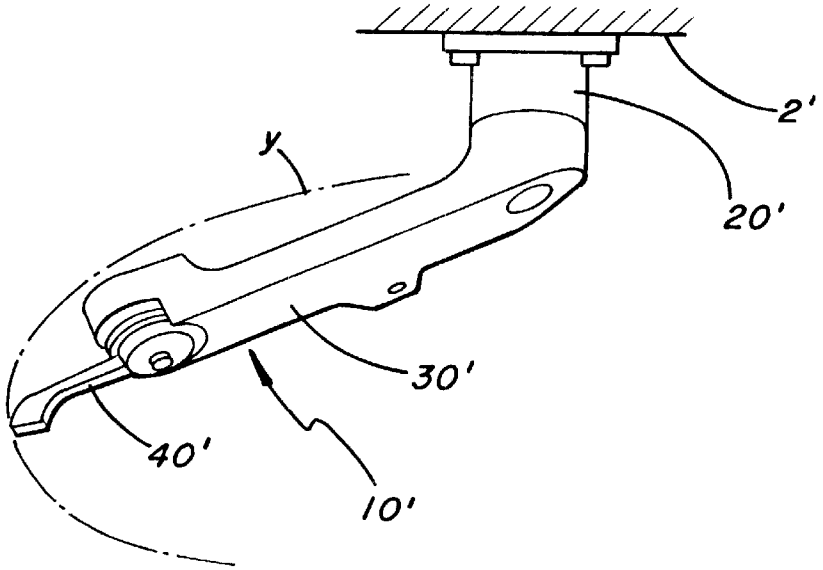
FIG 6B PRIOR ART

6) As shown in FIGS. 5A–5C, a guide 39 for determining a position of the cable 46 is formed integrally on an outer circumference of the base 32 of the arm 30. The cable 46 for connecting the throttle lever 40 and the carburetor 4 and an electric wire (not shown) from the stop switch 41 to the engine 3 are wired on the inside of the arm 30 as shown in FIG. 2A and extend outside from the base 32 as shown in FIG. 5A. When the controller 10 is mounted on the working machine 1 as shown in FIG. 2A, the cable 46 or the like winds around the outer circumference of the base 32 (according to an arrow of FIG. 5B). The guide 39 prevents thus winding cable 46 from deflecting to the holder 20's side. If the cable 46or the like moves to the holder 20's side and is sandwiched between the holder 20 and the base 32, the arm 30 neither swings (see FIG. 3A) nor moves smoothly (see FIGS. 1B and 1C).

The materials of the holder 20 and the arm 30 are required to provide light weight, a low cost, and endurance and to make the operator feel less exhausted. For example, the holder 20 and the arm 30 are made of nylon(polyamide)-based plastic. It may be decided whether or not the plastic is fiber-reinforced according to a role of each of the holder 20 and the arm 30. More specifically, it is preferable that the holder 20 serving as a base for supporting the arm 30 has high strength, high hardness, and high rigidity, and therefore, it is made of nylon containing 20% glass. While it is preferable that shocking stress is hardly generated at the base 32 or the holder 20 when the external force is unintenionally applied on the arm 30 and vibration during the operation is less likely to be transmitted to the operator's arm. Therefore, the arm 30 is made of a material that is not reinforced by fiber, that is, a material that is more flexible and less rigid than the fiber-reinforced material. It should be noted that resin as. matrix may be changed into polyethylene, polypropylene, or the like, although the need for fiber reinforcement of the holder 20 and arm 30 is determined according to the above example.

As for the section 3) configuration mentioned above, the following alternate configurations may be adopted.

3-a) Instead of using the exemplary configuration in which the end of the cylindrical portion 23 of the holder 20 has the inclined surface 23*a* and the end face 33 of the arm 30 is a flat plane, the protrusion 22 and the base 32 of the arm 30 may have an alternative configuration in which the end face 33 is the inclined plane, the end face of the cylindrical portion 23 has the flat surface, and a part of them may be in contact with each other. Further, the end face 33 and the cylindrical portion 23 may have inclined planes and a part of them may be in contact with each other.

3-b) It is not always required that: the recess 34 be in contact with the inclined surface 24*a* and the end face 33 be in contact with the inclined surface 23*a*. The contact of one of these is required.

3-c) The end face 33 of the arm 30 may be in contact with a middle portion of the inclined surface 23*a* of the holder 20.

3-d) A sufficient clearance may be provided in a fitting portion between the cylindrical portion 24, and the recess 34, and an elastic material such as rubber may be inserted into the clearance. The elastic material positions the arm 30 and absorbs shock or vibration.

3-e) The arm 30 (recess 34) may be in contact with a middle portion of the inclined surface 24*a* of the holder 20.

3-f) The cylindrical portion 23 may have a flat surface rather than the inclined surface 23*a* and the elastic material such as rubber or spring may be inserted between the end face 33 of the arm 30 and the end of the cylindrical portion 23.

3-g) For higher stability of the positioning of the arm 30, a parallel portion (right circular cylindrical portion) of a small length is formed at the base of the cylindrical portion 24 and the inclined surface 24*a* may be formed at a further end portion thereof.

3-h) Instead of using the inclined surface 23*b* as the circumferential inner surface facing the spring 38, a space for preventing the spring or the bolt from making contact with the surface may be provided between the spring 38 and the circumferential inner surface 23*b*.

In addition, the material of the holder 20 or the arm 30 is not limited to combination of a fiber-contained plastic (holder 20)and a normal plastic (arm 30) not containing fiber. The arm 30 may be made of a variety of flexible materials, and the holder 20 may be made of a variety of materials that are more rigid and higher in strength than those of the arm 30 and have desired characteristics, whereby preferable effects are achieved.

EXAMPLES 7-a) The holder 20 may be made of plastic having rigidity and strength higher than or equal to those of the fiber-contained plastic.

7-b) The holder 20 may be made of metal such as an aluminum casting.

Numerous modifications and alternative embodiments of the invention will be apparent to those skilled in the art in view of the foregoing description. Accordingly, the description is to be constructed as illustrative only, and is provided for the purpose of teaching those skilled in the art the best mode of carrying out the invention. The details of the structure and/or function may be varied substantially without departing from the spirit of the invention.

What is claimed is:

1. A backpack-type working machine comprising a power unit mounted on a shouldering frame and a swingable arm having a control device that is attached to a side thereof, wherein a base of the arm is connected to a holder provided on a body of the working machine at a swing center of the arm by an elastic pivot means, and the base of the arm and the holder are connected to each other such that the arm and the holder abut with each other at a pair of opposing surfaces formed about said swing center between the arm and the holder, at least one of said surfaces being inclined, away from the other, in a direction radially outward of said swing center to allow the arm to move on a plane orthogonal to a direction in which the arm swings.

2. The backpack-type working machine according to claim 1, wherein the holder is provided with a protrusion to engage with the arm, the protrusion being provided with a protrusion contact surface at a base thereof, the arm is provided with a recess for rotatably engaging the protrusion, the recess being provided with a recess contact surface of the arm in a peripheral portion thereof that is opposite to the protrusion contact surface of the holder, and at least one of the protrusion contact surface and the recess contact surface is inclined away from the other so that the arm and the holder abut with each other at only a part of each of the surfaces.

3. The backpack-type working machine according to claim 2, wherein at least one of a side surface of the protrusion of the holder and a side surface of the recess of the arm is inclined away from the other so that the arm can swing in a plane including an axis of the protrusion.

4. The backpack-type working machine according to claim 1, wherein convex and concave portions for engagement that maintain angles of the arm at positions where an end of the arm is directed upward and forward are formed in opposite surfaces of the base and the holder.

5. The backpack-type working machine according to claim 4, the protrusion contact surface of the holder and the recess contact surface of the arm provide the convex portion and the concave portion are provided for being engaged with each other to maintain said angles.

6. The backpack-type working machine according to claim 1, wherein the holder is formed of fiber-reinforced plastic and the arm is formed of plastic that is not fiber-reinforced so the holder has a higher hardness and rigidity than that of the arm.

7. The backpack-type working machine according to claim 1, wherein the pivot means is placed horizontally on a side portion of the working machine such that a center line of the pivot means is directed obliquely rearward when an operator shoulders the working machine, and the arm extends in a direction orthogonal to the center line of the pivot means such that the arm moves on a substantially vertical plane.

8. A backpack-type working machine. comprising a power unit mounted on a shouldering frame and a swingable arm having a control device that is attached to a side thereof, wherein a base of the arm is connected rotatably and elastically to a holder provided on a body of the working machine at a swing center of the arm with a pivot means through and elastic body, and a cylindrical recess is formed at the base of the arm and an end face of the arm at the recess is an uninclined surface, the holder has a protrusion formed of two cylindrical portions, one of which is a partial contact with the end face and the other is fitted into the recess with an inclined surface tapered in toward the axis of the protrusion toward an upper end thereof, to allow the arm to swingably move on a plane orthogonal to a direction in which the arm swings about said swing center.

* * * * *

UNITED STATES PATENT AND TRADEMARK OFFICE

CERTIFICATE OF CORRECTION

PATENT NO. : 6,431,024 B1
APPLICATION NO. : 09/539576
DATED : August 13, 2002
INVENTOR(S) : Yuasa et al.

It is certified that error appears in the above-identified patent and that said Letters Patent is hereby corrected as shown below:

On Title page (73) After "Hyogo (JP)", insert --; Maruyama Mfg. Co., Inc., Tokyo (JP)--.

Signed and Sealed this

Seventeenth Day of November, 2009

David J. Kappos

David J. Kappos
*Director of the United States Patent and Trademark Office*